United States Patent [19]

Styles et al.

[11] Patent Number: 5,013,099

[45] Date of Patent: May 7, 1991

[54] TISSUE DISPENSER

[76] Inventors: Delbert G. Styles; Keunja Styles, both of 3811 N. 48th Dr., Phoenix, Ariz. 85031

[21] Appl. No.: 468,187

[22] Filed: Jan. 22, 1990

[51] Int. Cl.[5] ..... B65H 19/00

[52] U.S. Cl. ..... 312/37

[58] Field of Search ..... 312/37, 290, 248, 328

[56] References Cited

U.S. PATENT DOCUMENTS 2,333,399 11/1943 Wagner ..... 312/290 X 2,506,533 5/1950 Winborne ..... 312/328 X 2,823,931 2/1958 Hoyt ..... 312/290

3,762,390 10/1973 Neuwirth ..... 312/248 X

*Primary Examiner*—Joseph Falk

*Attorney, Agent, or Firm*—Harry M. Weiss

[57] ABSTRACT

A tissue dispenser is provided for use in supplying new tissues and for storing used tissues. The dispenser includes a housing for new tissues which has front and rear walls, left and right sidewalls, bottom and top walls, and a middle wall, which separates an upper chamber containing a tissue box from a lower chamber containing the drawer. A top opening in the top wall is used for extracting a new tissue. The left sidewall has an opening for placing a new tissue box in the upper chamber under the top opening.

1 Claim, 1 Drawing Sheet

TISSUE DISPENSER

The invention generally relates to a tissue dispenser, and in particular the invention relates to a tissue dispenser having a removable disposal container.

BACKGROUND OF THE INVENTION

The prior art tissue dispenser is described in U.S. Pat. No. 4,022,319 issued May 10, 1977. Related patents include U.S. Pat, Nos.:

| |
|---|
| 1,679,231; issued July 31, 1928 |
| 2,007,042; issued July 02, 1935 |
| 3,845,858; issued November 05, 1974 |
| 4,106,617; issued August 15, 1978, and |
| 4,644,689; issued February 24, 1987. |

The prior art tissue dispenser includes a housing having front and rear walls, a top wall, a Z-shaped bottom wall, and left and right sidewalls. The top wall has an opening for inserting a used tissue therethrough and the bottom wall has a bottom opening for removing a new tissue.

One problem with the prior art tissue dispenser is that when a new tissue is being removed from the bottom opening, additional tissues tend to fall through the bottom opening.

SUMMARY OF THE INVENTION

According to the present invention, a tissue dispenser is provided. This dispenser comprises a housing having front and rear walls, top and bottom walls, and left and right sidewalls. The top wall has a top opening for removing a new tissue and the front wall has a disposal drawer for inserting a used tissue.

By using a top wall having a top opening for removing a new tissue, the problem of having additional tissue tending to fall through the opening, when a new tissue is being removed, is avoided.

The foregoing and other objects, features and advantage will be apparent from the following description of the preferred embodiment of the invention as illustrated in the accompanying drawings.

DESCRIPTION OF PREFERRED EMBODIMENT

Figure 1:
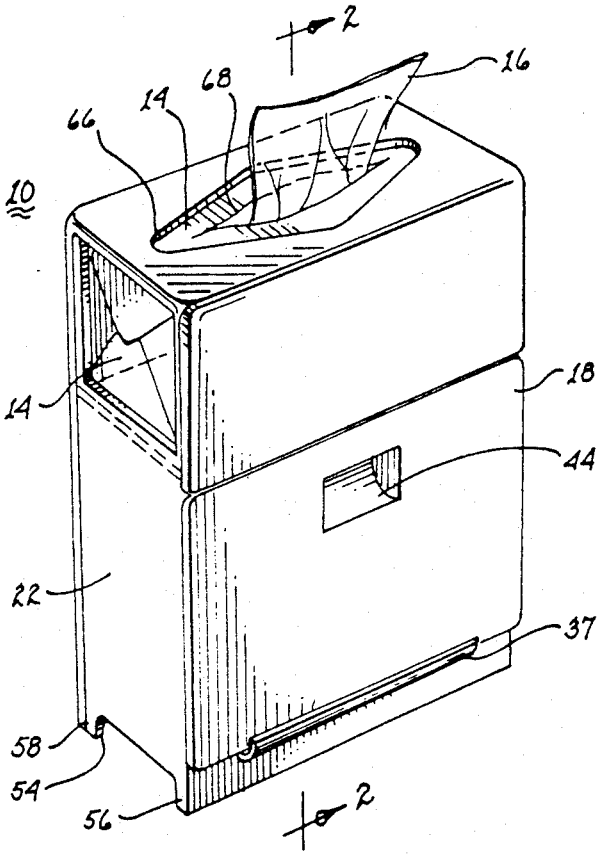
FIG. 1 is a perspective view of a tissue dispenser according to the invention.
Figure 2:
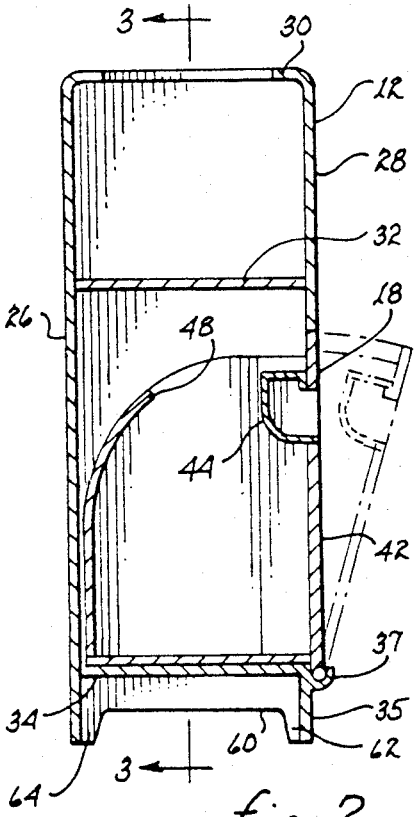
FIG. 2 is a section view taken along the line 2—2 of FIG. 1.
Figure 3:
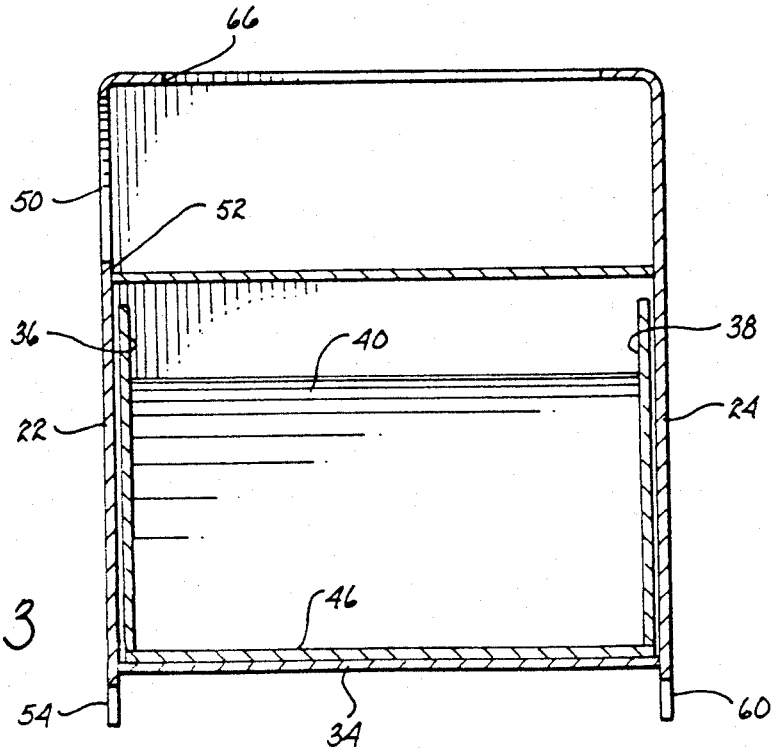
FIG. 3 is a section view taken along the line 3—3 of FIG. 2.

As shown in FIGS. 1,2 and 3, a dispenser 10 is provided. The dispenser 10 includes a housing 12 for holding a tissue box 14 which contains a plurality of folded, flat new tissues 16, and includes a disposal drawer 18 for retaining used tissues.

The housing 12 includes a left sidewall 22, a right sidewall 24, a rear wall 26, an upper fixed front wall 28, a top wall 30, a middle wall 32, a bottom wall 34, and a stub wall 35. The middle wall 32 supports the tissue box 14. The stub wall 35 supports the bottom wall 34. Extending forward from the stub wall 35 is a curved channel 37. The walls 30, 32, 34 are like horizontal shelves.

The drawer 18, which is removable, includes a left plate 36, a right plate 38, a rear plate 40, a front plate 42, which has a grip 44, and a bottom plate 46. The bottom edge of the front plate 42 is rounded so as to be rotably disposed in the channel 37. When partly open, the drawer 18 has a drawer opening 48 for inserting a used tissue.

The left sidewall 22 has a sidewall opening 50, which has a ledge 52 for preventing the tissue box 14 from sliding out of the opening 50. The left sidewall 22 also has a bottom cutout 54, which forms front and rear left legs 56, 58. The right sidewall 24 has a corresponding bottom cutout 60, which forms front and rear right legs 62, 64.

The top wall 30 has a top opening or cutout 66, which has a oblong shape, and which is used for removing the new tissues 16. The tissue box 14 has an aligned box opening 68, through which the new tissue 16 is extracted.

The housing 12 and the drawer 18 are composed of a marbleized plastic material. The edges of the housing 12 and the drawer 18 are rounded off. The dispenser 10 can be carried by holding the cutout 66. The wall 30 is made strong enough to support the housing 12 and the drawer 18, when held at the cutout 66.

The advantage of the dispenser 10 are indicated hereafter.

(A) The top wall 30, which has the top opening 66, permits removal of one new tissue, while avoiding the problem of having additional tissues falling through the opening 66. Also, the top opening 66 acts as a handle for carrying the housing 12.

(B) The side opening 50 permits one-handed removal and replacement of a tissue box 14, for ease of supply of a new tissue box 14.

(C) The drawer 18 permits one-handed removal and replacement of the drawer 18 for ease of disposal of used tissues, which are collected therein.

While the invention has been described in its preferred embodiment, it is to be understood that the words which have been used are words of description rather than limitation and that changes may be made within the purview of the appending claims without departing from the true scope and spirit of the invention in its broader aspects.

I claim:

1. A combined tissue dispenser and tissue storage assembly comprising, in combination:

a tissue box having an opening in a top surface thereof; at least one tissue extending outwardly from said opening in said tissue box;

removable drawer means comprising an outwardly movable drawer located on the front of said assembly for storing used tissues;

said assembly having a first compartment means located at a top portion of said assembly for holding said box of tissues and having a second compartment means located at a bottom portion of said assembly, open on one side, for slidably receiving said drawer means, said first compartment means has a first opening means located on one side of said first compartment means an don one side of said assembly for inserting therethrough said box of tissues and a second opening means located above said opening in said tissue box and on top of said first compartment means for extracting said tissue therefrom.

* * * * *